US012188384B2

(12) United States Patent
Guaschino et al.

(10) Patent No.: US 12,188,384 B2
(45) Date of Patent: Jan. 7, 2025

(54) LATCHING PIN ASSEMBLY AND DEACTIVATING ROCKER ARM ASSEMBLY

(71) Applicant: Eaton Intelligent Power Limited, Dublin (IE)

(72) Inventors: Mirko Guaschino, Prague (CZ); Marco Ravoni, Turin (IT); Nicola Andrisani, Turin (IT); Michele Angelo Cecchi, Turin (IT); Massimo D'Amore, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/251,253

(22) PCT Filed: Nov. 10, 2021

(86) PCT No.: PCT/EP2021/025437

§ 371 (c)(1),
(2) Date: May 1, 2023

(87) PCT Pub. No.: WO2022/100886

PCT Pub. Date: May 19, 2022

(65) Prior Publication Data

US 2023/0407771 A1 Dec. 21, 2023

Related U.S. Application Data

(60) Provisional application No. 63/111,772, filed on Nov. 10, 2020.

(51) Int. Cl.
*F01L 1/24* (2006.01)
*F01L 1/18* (2006.01)
(Continued)

(52) U.S. Cl.
CPC ..... *F01L 1/2416* (2013.01); *F01L 1/181* (2013.01); *F01L 13/0005* (2013.01);
(Continued)

(58) Field of Classification Search
CPC ..... F01L 2001/467; F01L 13/0005; F01L 2810/02; F01L 1/2416; F01L 2001/186; F01L 1/181
See application file for complete search history.

(56) References Cited

U.S. PATENT DOCUMENTS 5,584,268 A 12/1996 Natkin et al.
8,550,047 B2 * 10/2013 Odell ..... F01L 13/0036 123/90.39
(Continued)

FOREIGN PATENT DOCUMENTS

DE 102018114572 12/2018
EP 1143120 A2 10/2001
(Continued)

OTHER PUBLICATIONS

International Search Report issued in corresponding application No. PCT/EP2021/025437 dated Feb. 28, 2022, 5 pages.
Written Opinion issued in corresponding application No. PCT/EP2021/025437 dated Feb. 28, 2022, 9 pages.
Office Action for Japanese Application No. 2023-522854 dated Nov. 6, 2024.

*Primary Examiner* — Ngoc T Nguyen
(74) *Attorney, Agent, or Firm* — Meunier Carlin & Curfman LLC

(57) ABSTRACT

A latch assembly (500) can comprise a main latch pin assembly (531, 532) comprising a first diameter (D1) on a first main pin face (512, 522), and a secondary latch piston (541, 561) comprising a second diameter (D2) on a secondary piston face (543, 563). The secondary latch piston can be configured to selectively act on the main latching pin assembly. The main latch pin assembly can be biased to oppose the secondary latch piston. The first diameter can be
(Continued)

greater than the second diameter. A rocker arm assembly (10) can comprise the latch assembly. A primary arm (100) can be configured to receive the main latch pin assembly. A secondary arm (300) can be configured to receive the secondary latch piston.

17 Claims, 6 Drawing Sheets

(51) Int. Cl.
*F01L 1/46* (2006.01)
*F01L 13/00* (2006.01)

(52) U.S. Cl.
CPC ... *F01L 2001/186* (2013.01); *F01L 2001/467* (2013.01); *F01L 2810/02* (2013.01)

(56) References Cited

U.S. PATENT DOCUMENTS

| | | | | |
|---|---|---|---|---|
| 2017/0009610 | A1 | 1/2017 | Ahmed et al. | |
| 2018/0363519 | A1 | 12/2018 | Radulescu et al. | |
| 2020/0408113 | A1* | 12/2020 | Radulescu ..... | F01L 1/047 |

FOREIGN PATENT DOCUMENTS

| | | | |
|---|---|---|---|
| JP | 2015-224638 | A | 12/2015 |
| WO | 2020/030298 | A1 | 2/2020 |
| WO | 2021/239273 | A1 | 12/2021 |

* cited by examiner

LATCHING PIN ASSEMBLY AND DEACTIVATING ROCKER ARM ASSEMBLY

FIELD

This application provides a latching pin system usable in a deactivating rocker arm assembly.

BACKGROUND

There are particular packaging constraints that can lead to the possibility of have the latching pins locked or stuck in a certain position by the load received. Then, a rocker arm assembly cannot switch between modes.

SUMMARY

By moving the latch assembly location, the tendency of the locking or sticking can be alleviated. Additional options support the change in location.

The methods and devices disclosed herein overcome the above disadvantages and improves the art by way of a latch assembly and a rocker arm assembly usable therewith.

A latch assembly can comprise a main latch pin assembly comprising a first diameter on a first main pin face, and a secondary latch piston comprising a second diameter on a secondary piston face. The secondary latch piston can be configured to selectively act on the main latching pin assembly. The main latch pin assembly can be biased to oppose the secondary latch piston. The first diameter can be greater than the second diameter.

The main latch pin assembly can comprise a main pin body that is stepped from an outer diameter to the first diameter. The main pin body can comprise at least one anti-rotation flat.

The secondary latch piston can comprise a piston body cupped to receive an actuation fluid. The piston body can be crenelated or gapped to form an actuation fluid passage.

A rocker arm assembly can comprise the latch assembly. A primary arm can be configured to receive the main latch pin assembly. A secondary arm can be configured to receive the secondary latch piston.

The primary arm can comprise a latch shelf proximal a primary rocker shaft bore. The main latch pin assembly can be installed in a primary latch bore in the latch shelf. The secondary arm can comprise a latch extension proximal a secondary rocker shaft bore. The secondary latch piston can be installed in a secondary latch bore in the latch extension.

The secondary latch bore can be stepped from a first inner diameter guiding the secondary latch piston to a second inner diameter that is larger than the first inner diameter. The primary latch pin assembly can be biased to abut the second inner diameter when the secondary latch piston is passive.

The main latch pin assembly can comprise a main pin body that is stepped from an outer diameter to the first diameter. The step can abut the second inner diameter when the secondary latch piston is passive.

The primary arm can comprise a primary travel limit. The secondary arm can comprise a secondary travel limit. The secondary travel limit can contact the primary travel limit when the latch assembly is latched. But, the secondary travel limit can be configured to swing away from the primary travel limit when the latch assembly is unlatched.

The latch shelf can comprise an anti-rotation bore and an anti-rotation pin installed in the anti-rotation bore. The main latch pin assembly can comprise at least one anti-rotation flat configured to reciprocate across the anti-rotation pin.

The rocker arm assembly can comprise a lost motion spring assembly spanning from the primary arm to the secondary arm.

The rocker arm assembly can comprise a bearing end on the secondary arm and a valve end on the primary arm. The bearing end, the valve end, and the latch assembly can be configured to surround a rocker shaft in a triangular distribution.

The primary arm can comprise a lubrication port to the main latch pin assembly. The secondary arm can comprise an actuation port to the secondary latch piston. The secondary latch piston can comprise a piston body cupped to receive an actuation fluid.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1:
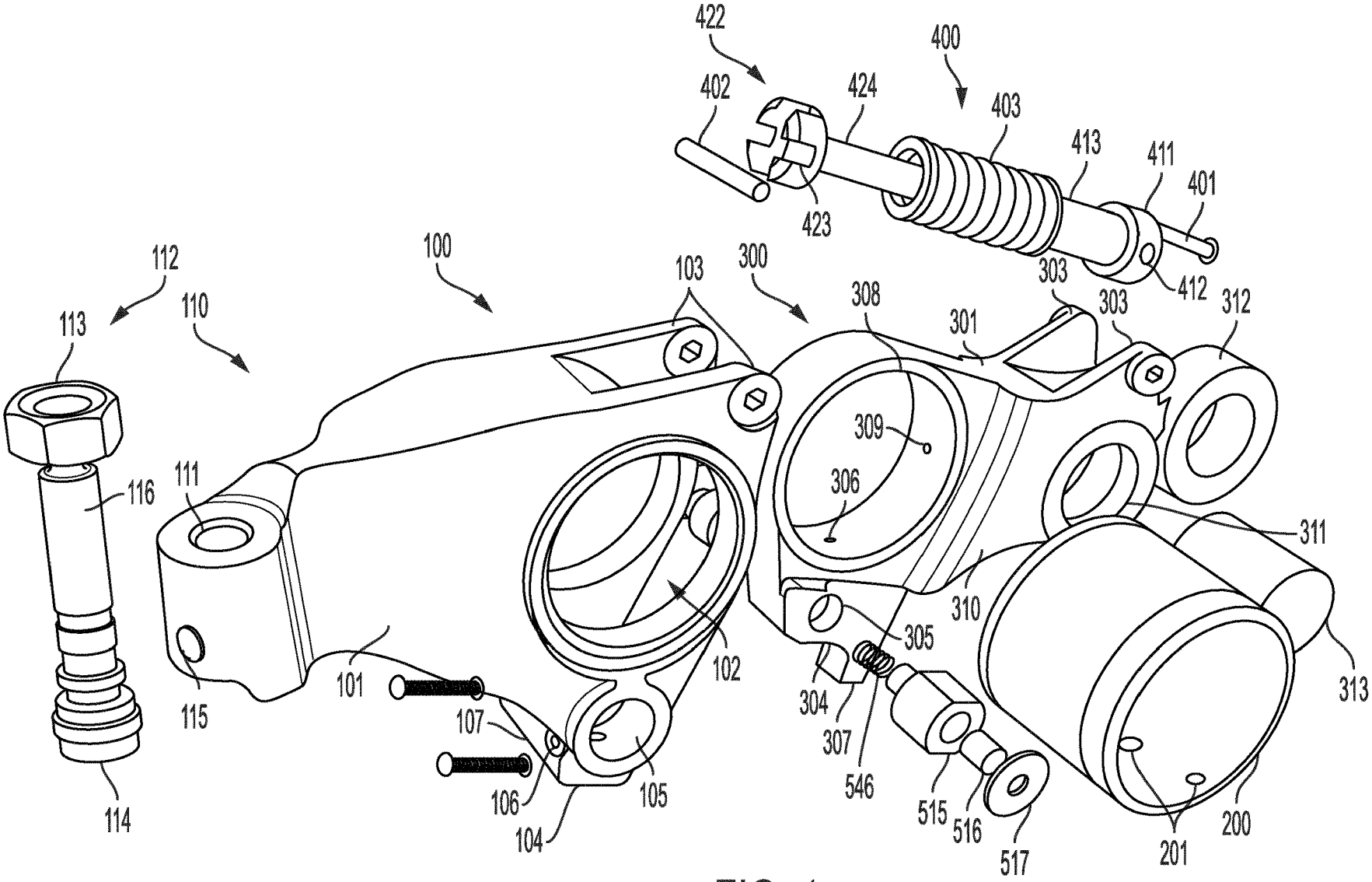
FIG. 1 is an exploded view of a rocker arm assembly comprising a latch assembly.
Figure 2:
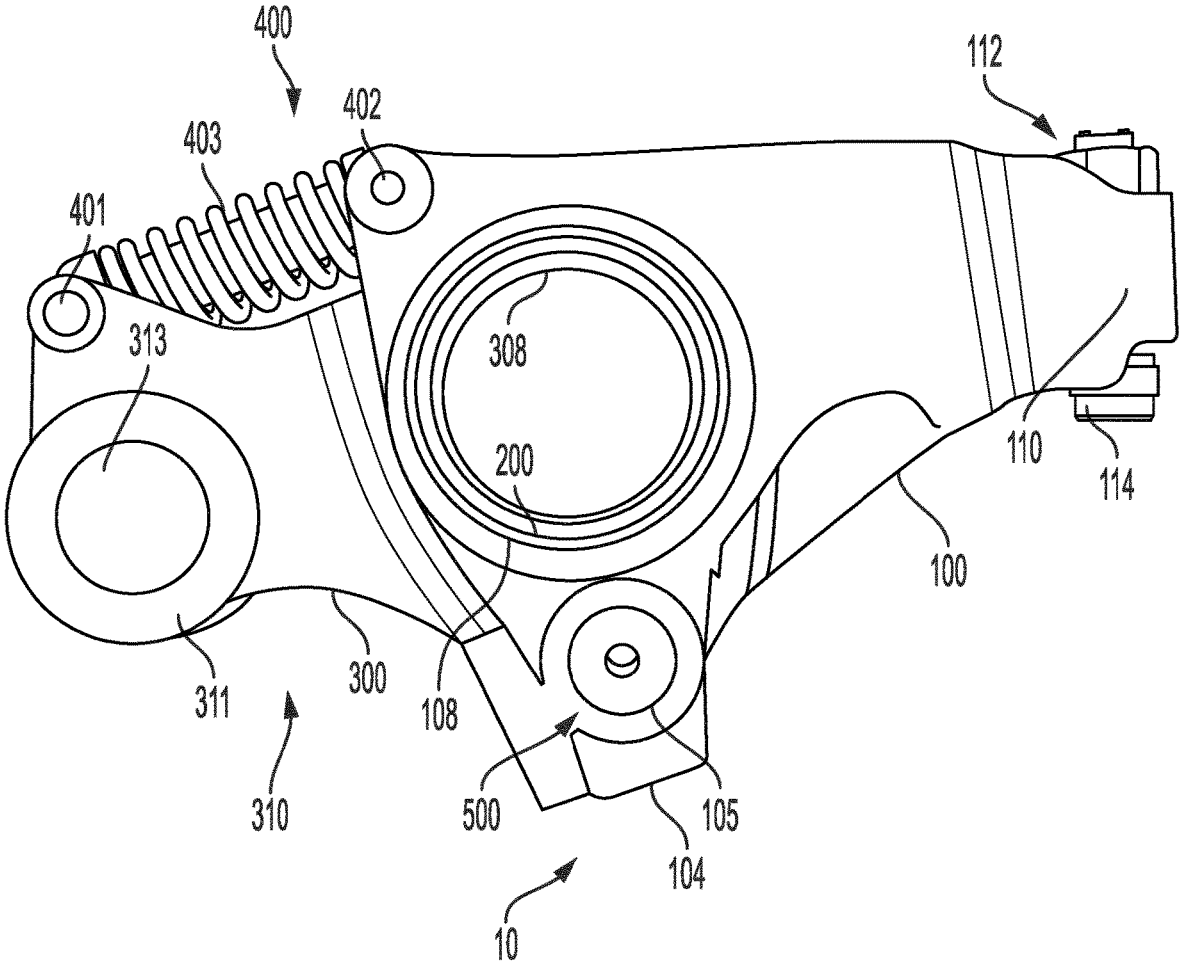
FIG. 2 is side view of the rocker arm assembly, including the triangular distribution of the bearing end, the valve end, and the latch assembly.

A latch assembly 500 can comprise at least one main latch pin assembly 531 and at least one secondary latch piston 541. Several Figures show first and second main latch pin assemblies 531, 532 working together with first and second secondary latch pistons 541, 561. While a receptacle wall can be used to form a system for the single main latch pin assembly 531 and single secondary latch piston 541, the illustration comprising pairs can reduce the spring force of pin springs 519, 529 and actuation force of actuation fluid to a pair of secondary latch pistons 541, 561. For convenience, the first and second main latch pin assemblies 531, 532 can be referred to as outer latch pins while the secondary latch pistons 541, 561 can be referred to as inner pistons.

First and second main latch pin assemblies 531, 532 can comprise first and second latch pins 501, 502 with pin bodies 511, 521 comprising a first diameter D1 on a first main pin face 512, 522. Secondary latch pistons 541, 561 can comprise piston bodies 542, 562 comprising a second diameter D2 on a secondary piston face 543, 563. The first diameter D1 can be greater than the second diameter D2 (D1>D2). This relationship can be true even if the main latch pin assemblies 531, 532 comprise a main pin body 511, 521 that is stepped from an outer diameter OD1 to the first diameter. Outer step 514, 524 can be formed. Several optional benefits can be implemented: the primary latch bores 105, 125 can have a greater diameter than the first diameter to give stability to the primary latch pin assemblies; the pin springs 519, 529 can be wider to yield flexibility in the spring force k; and, the outer steps 514, 524 can serve to set lash for the rocker arm assembly 10. Additional features on the main pin bodies 511, 521 can comprise at least one anti-rotation flat 515, 525. Also, a spring cup 516, 526 can guide the pin springs 519, 529 as they expand and collapse against the bushing or snap ring 517, 527 seated in guide grooves 135, 136 of the primary arm latch bores 105, 125. Additional spring guides 518, 528, as necks or grooves, can be formed in the bushing or snap ring 517, 527. The travel of the main pin bodies 511, 521 in the primary latch bores 105, 125 can be restricted by the placement of the bushings or snap rings 517, 527.

The secondary latch pistons 541, 561 can be configured to selectively act on the main latching pin assemblies 531, 532. In the Figures, this is accomplished via actuation fluid from a rocker shaft to the rocker bores. The main latch pin assemblies 531, 532, by the pin springs 519, 529, can be biased to oppose the secondary latch pistons 541, 561.

The secondary latch pistons 541, 561 can comprise piston bodies 542, 562 cupped to receive an actuation fluid. A cavity 544, 564 can be formed in each piston body 542, 562 to receive the actuation fluid. The piston bodies 542, 562 can be crenelated or gapped to form an actuation fluid passage 548, 568. Teeth 545, 565 spaced with gaps are one way to form the actuation fluid passages 548, 568. An optional piston spring 546 can push the secondary latch pistons 541, 561 apart by a preset amount that is typically overcome by the pin springs 519, 529. But, the optional piston spring 546 can prime the motion of the secondary latch pistons 541, 561. The optional piston spring 546 can push the piston facings 543, 563 to contact the main pin facings 512, 522.

A rocker arm assembly 10 can comprise the latch assembly 500. A primary arm 100 can be configured to receive one or both main latch pin assembly 531, 532. A secondary arm 300 can be configured to receive one or both secondary latch piston 541, 562. By splitting the primary rocker arm body 101 to comprise a pivot slot 102, the secondary arm 300 can pivot around a rocker shaft (with or without optional bushing 200) in the pivot slot 102. The split primary rocker arm 100 can also form mirror image portions for housing the first and second main latch pin assemblies 531, 532. The mirror image portions can flank a portion of the secondary rocker arm body 301. So, a latch shelf 104 can be formed as part of the primary rocker arm body 101. The latch shelf 104 can comprise a pair of primary latch bores 105, 125. A portion of the latch shelf 104 can comprise a primary travel limit 107.

The primary arm 100 can comprise the latch shelf 104 proximal a primary rocker shaft bore 108. The main latch pin assembly 531, 532 can be installed in a primary latch bores 105, 125 in the latch shelf 104. Lubrication ports to the primary latch bores 105, 125 from the primary rocker shaft bore 108 are optional.

The secondary arm 300 can comprise a latch extension 304 proximal a secondary rocker shaft bore 308. The secondary latch pistons 541, 561 can be installed in a secondary latch bore 305 in the latch extension 304.

Figure 4:
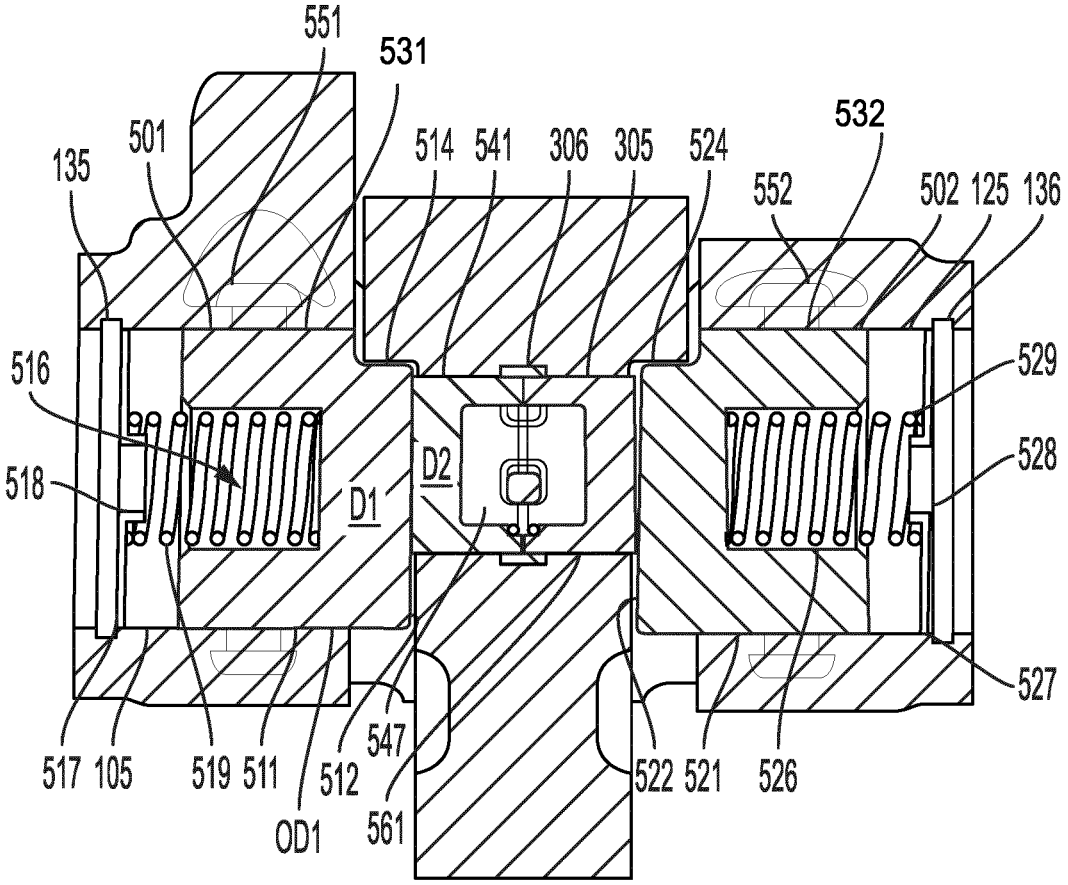
FIG. 4 is a cross-section view of the latch assembly latched in the rocker arm assembly.
Figure 5:
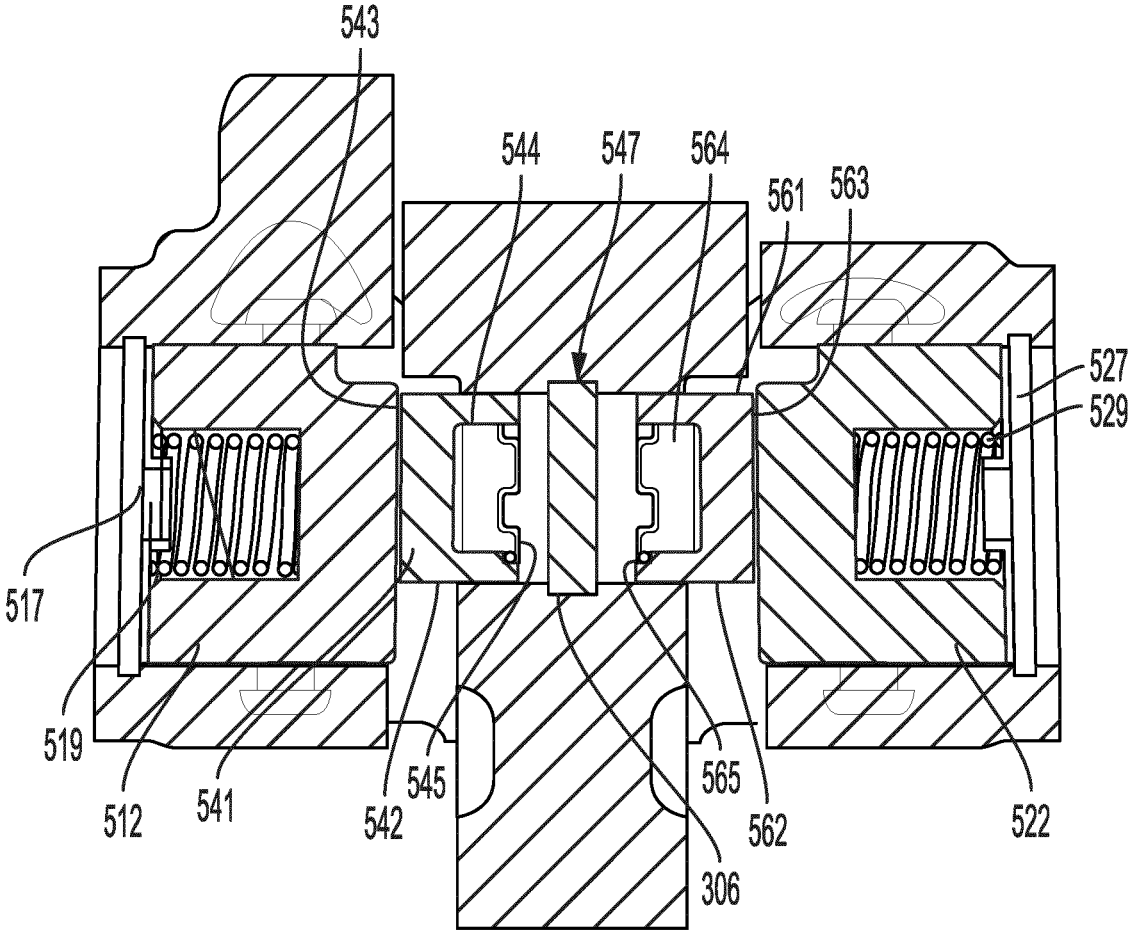
FIG. 5 is a cross-section view of the latch assembly unlatched in the rocker arm assembly. The main latch pin assemblies are acted on by the secondary latch pistons. The secondary travel limit is configured to swing away from the primary travel limit.
Figure 7:
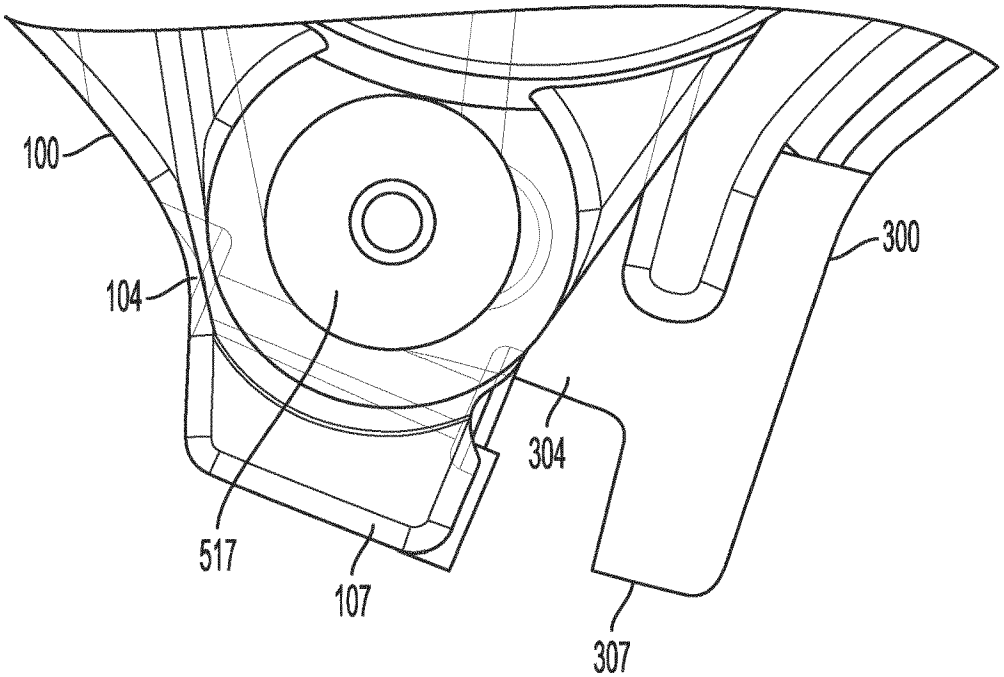
FIGS. 6 & 7 are views of the latch assembly unlatched in the rocker arm assembly with the secondary travel limit swinging away from the primary travel limit.
Figure 6:
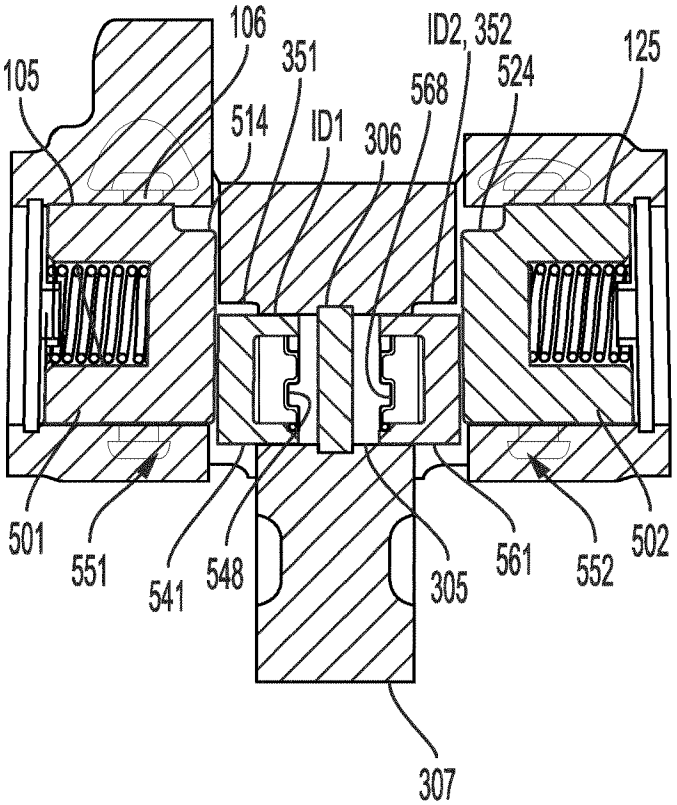

The primary arm 100 can comprise a primary travel limit 107. The secondary arm 300 can comprise a secondary travel limit 307. The secondary travel limit 307 can contact the primary travel limit 107 when the latch assembly 500 is latched (FIG. 4). But, the secondary travel limit 307 can be configured to swing away from the primary travel limit 107 when the latch assembly is unlatched (FIGS. 5-7). The primary travel limit 107 can comprise a wall or prong or finger of material of the latch shelf 104. A complementary wall or prong or finger of material on the latch extension 304 can be shaped to abut the primary travel limit 107. Lightweighting and durability can be factors in the size and shape of the complementing primary travel limit 107 and secondary travel limit 307. In another aspect, the cooperation of the primary travel limit 107 and secondary travel limit 307 serve to smooth latching and unlatching of the latch assembly 500. By restricting overtravel of the primary arm 100 relative to the secondary arm 300, the primary latch bore 105, 125 aligns readily with the secondary latch bore 305. By forming bore steps 351, 352 in the secondary latch bore 305, lash take-up can be designed into the rocker arm assembly 10. Lash take-up can also be designed into the rocker arm assembly 10 by way of the outer step 514, 524 on the pin bodies 511, 521.

The latch shelf 104 can comprise one or more anti-rotation bore 106 and one or more anti-rotation pin 551, 552 installed in the anti-rotation bores 106. Then, the outer steps 514, 524 can assuredly align with the bore steps 351, 352 when outer flats 515, 525 are aligned with the anti-rotation pins 551, 552. When the first and second secondary latch pistons 541, 561 act on the first and second main latch pin assemblies 531, 532, the at least one anti-rotation outer flat 515, 525 is configured to reciprocate (slide) across the anti-rotation pin 551, 552.

The secondary latch bore 305 can be stepped from a first inner diameter ID1 guiding the piston bodies 542, 562 or the secondary latch pistons 541, 561 to a second inner diameter ID2 that is larger than the first inner diameter (ID2>ID1). The main latch pin assembly 531, 532 can comprise the main latch pins 501, 502 with main pin bodies 511, 512 stepped from an outer diameter to the first diameter D1. The outer step 514, 524 so formed can abut the second inner diameter ID2 when the secondary latch piston 541, 561 is passive. The primary latch pin assembly 512, 522 can be biased to abut the second inner diameter ID2 when the secondary latch piston 541, 561 is passive. No actuation fluid pressure is supplied to the cavity 544, 564 in the passive condition. But, actuation fluid is supplied from a rocker shaft to one of the bushing ports 201 of optional bushing 200 or is supplied directly to a latch oil actuation port 306 in the secondary body 301 to cause the first and second secondary latch pistons 541, 561 to act on the first and second main latch pin assemblies 531, 532. Optionally, a rocker shaft can supply lubrication fluid to oil ports 309 to lubricate a roller bearing 312 on a bearing pin 313 installed in bearing mounts 311. Bearing end 310 can optionally include a cross-drill or vent 315 connected to oil ports 309. Bearing end 310 can alternatively comprise a tappet or other sliding surface.

The rocker arm assembly 10 can comprise a lost motion spring assembly 400 spanning from the primary arm 100 to the secondary arm 300. The lost motion spring assembly 400 can bias the latch extension 304 towards the latch shelf 104 so that the primary travel limit 107 contacts the secondary travel limit 307 during a portion of the valve cycle. The lost motion spring assembly 400 can comprise a spring guide 413 and plunger 424 secured by mounting pins 401, 402 at one of pivot knees 103, 303. A swivel end 411 can comprise a pin hole 412 for mounting pin 401 while stay end 422 comprises pin slot 423 for mounting pin 402. Lost motion spring 403 pushes the swivel end 411 and stay end 422 apart to return the rocker arm assembly to a position where the latch assembly 500 is aligned for latching or unlatching. But, lost motion spring 403 can be compressed when the latch assembly 500 is unlatched so that a lift profile is absorbed therein.

The rocker arm assembly 10 can comprise a bearing end 310 on the secondary arm 300 and a valve end 110, 120 on the primary arm 100. The bearing end 310, the valve end 110, 120, and the latch assembly 500 can be configured to surround a rocker shaft in a triangular distribution. The rocker shaft being mountable in the primary rocker shaft bore 108 and the secondary rocker shaft bore 308, this can also be phrased that the bearing end 310, the valve end 110, 120, and the latch assembly 500 can be configured to surround the primary rocker shaft bore 108 and the secondary rocker shaft bore 308 in a triangular distribution. Said yet another way, while the lost motion spring assembly 400 is balanced over the primary rocker shaft bore 108 and the secondary rocker shaft bore 308 and the bearing end 310, the latch assembly 500 is balanced under the primary rocker shaft bore 108 and the secondary rocker shaft bore 308. The actuation fluid and latch assembly 500 do not interfere with actuation fluid to any capsule or actuation in the valve end 110, 120, nor do they interfere with ordinary lubrication circuits. The location under the primary rocker shaft bore 108 and the secondary rocker shaft bore 308 yields a low-conflict area of the rocker arm assembly 10 to add deactivation mechanisms.

Figure 3:
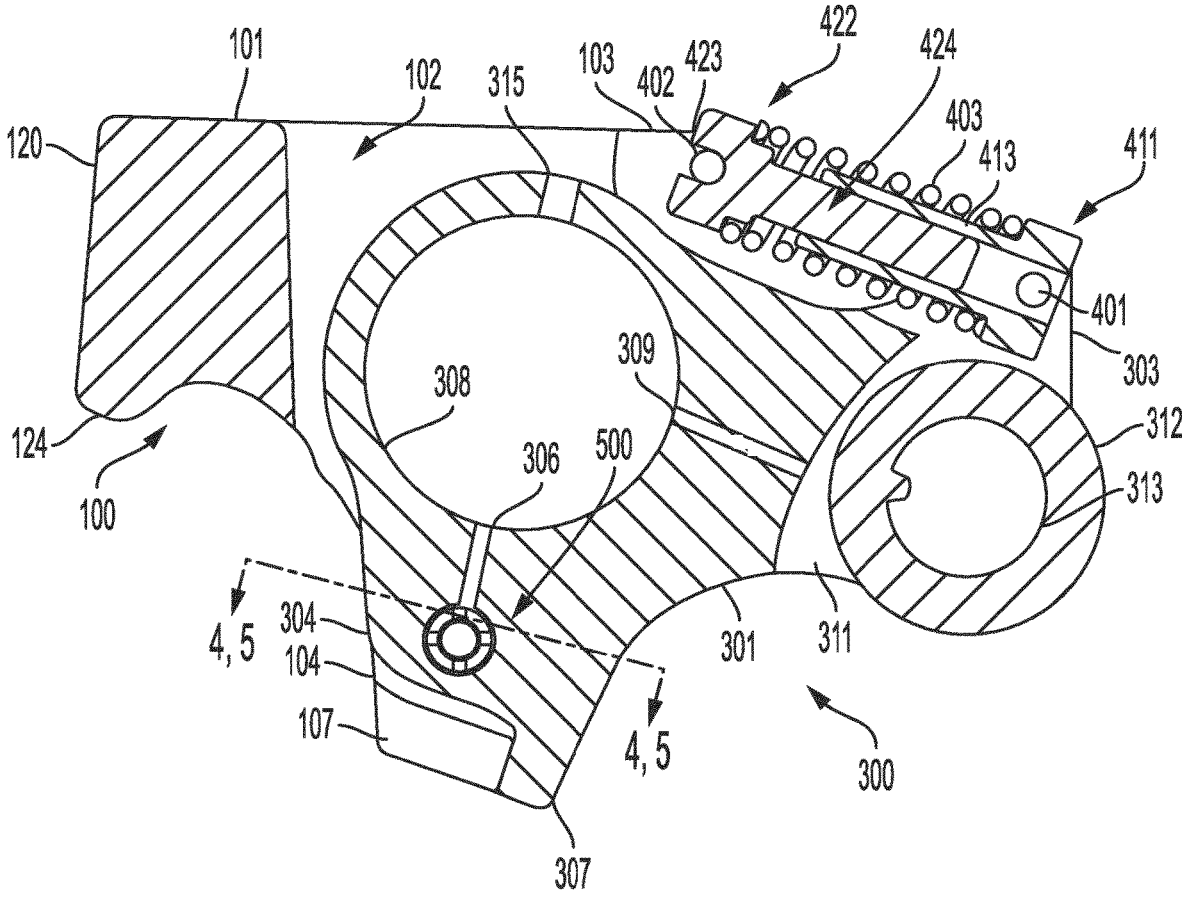
FIG. 3 is a cross-section view of an alternative rocker arm assembly, including a cross-section of the lost motion assembly and the latch assembly.

As an option, the valve end 110 can comprise a capsule bore 111. An actuation capsule such as a castellation capsule, a hydraulic lash adjuster, a switching capsule, among many options can be installed in the capsule bore 111. In FIG. 1, a mechanical lash device is shown to comprise a spigot assembly 112 with a lash nut 113, a lash pin 116, and an elephant foot (e-foot) 114. An optional vent 115 is included in the valve end 110. In FIG. 3, the primary body 101 is more simply illustrated with a valve end 120 comprising a knurl 124 to actuate on a valve stem or valve bridge.

The primary arm 100 can comprise an optional lubrication port to the main latch pin assemblies 501, 502. The secondary arm 300 can comprise an actuation port 306 to the secondary latch pistons 541, 561. The secondary latch pistons 541, 561 can comprise a piston body 542, 562 cupped to receive actuation fluid. The actuation fluid can be, for example, hydraulic fluid such as pressurized oil.

A latch assembly 500 disclosed herein provides a more reliable latching and unlatching function in a rocker arm assembly 10 such as a deactivating roller rocker arm (RRA) when the loads could otherwise cause the latching pins to stick.

Hydraulic activation of the latching function can be ported through the rocker arm assembly 10 by way of a rocker shaft with the hydraulic activation contained in the rocker arm assembly 10. Then, external hoses and actuators are not mandatory. The main latch pin assemblies 531, 532 are in a normally latched condition thanks to the reaction of the pin springs 519, 529. Since the function activation is not directly applied on them, this allows a longer guided length of the pin bodies 511, 521. The first and second secondary latch pistons 541, 561 do not receive the latching load but do receive the force of the oil during activation of the deactivation function of the RRA. With no latching load applied, these first and second secondary latch pistons 541, 561 can be smaller. The combination of the two latching systems to form the latch assembly 500 allows the rocker arm assembly 10 to transmit the cam lift to the valve when the latch assembly 500 is engaged (latched) and allows the rocker arm assembly 500 to not transmit motion to the valve when the first and second secondary latch pistons 541, 561 receive hydraulic pressure to disengage the main latch pin assemblies 531, 532.

The rocker arm assembly 10 can be made by the primary arm 100 that provides the case for the main latch pin assemblies 531, 532 and the pin springs 519, 529 and the secondary arm 300 that provides the case for the first and second secondary latch pistons 541, 561 and the oil gallery for the function activation. The secondary arm can also provide a latching feature for the main latch pin assemblies 531, 532, as by diameter changes to the secondary latch bore 305.

DRIVE MODE: FIG. 4 shows that in this condition the main latch pin assemblies 531, 532 are pushed to jut out of the primary arm 100 thanks to the pin springs 519, 529 and they are latched on the secondary latch bore 305 (which can include the second inner diameter ID2 latching feature on the secondary arm 300). The secondary latch pistons 541, 561 are retracted inside the secondary arm 300 since they do not receive any pressure from the oil actuation port 306. In this configuration, when a cam rotates from base circle to a lift lobe, the motion is transmitted to the valve thanks to the connection provided by the main latch pin assemblies 531, 532 on the secondary arm 300.

FUNCTION ACTIVATION: when the deactivation of the rocker arm assembly 10 is selected, an oil input is sent to the oil actuation port 306 in the secondary arm 300. This allows the secondary latch pistons 541, 561 to expand and push against the main latch pin assemblies 531, 532. When the cam is on base circle, a geometrical lash between the main latch pin assemblies 531, 532 and the latching feature on the secondary arm 300 is provided. The geometrical lash can be a designed—for gap between the main latch pin assemblies 531, 532 and the second inner diameter ID2. When included, this can be a designed—for gap between outer step 514, 524 and inner diameter ID2. In this condition, it is possible for the secondary latch pistons 541, 561 to compress the main latch pin assemblies 531, 532 and disengage the primary arm 100 from the secondary arm 300. This is shown in FIG. 5. As for timing, when the cam is on a lift lobe, if the main latch pin assemblies 531, 532 are still engaged, the force between the main latch pin assemblies 531, 532 and the secondary arm 300 latching feature is higher than the force from the actuation oil on the secondary latch pistons 541, 561 and the disengagement is not provided. The latch assembly 500 does not convert from latched to unlatched if the actuation oil is provided during lift, but it can convert on base circle when the geometrical lash takes pressure from the secondary arm 300 off of main latch pin assemblies 531, 532. Functions for the rocker arm assembly 10 can include various variable valve actuation (VVA) techniques such as cylinder deactivation, braking, internal exhaust gas recirculation, early or late valve opening or closing, etc. Additional inner diameters can be included as the additional latching features to enable the other VVA techniques. For example, instead of valve deactivation, a different valve lift can be supplied as the VVA technique by stepping the main latch pin assemblies 531, 532 from an initial smaller inner diameter to a larger inner diameter. Deactivation mode is the working example, but it is not exclusive.

DEACTIVATION MODE: when the secondary latch pistons 541, 561 are fully extended, the main latch pin assemblies 531, 532 are not able to engage with the latching feature on the secondary arm 300. This allows a relative motion between the secondary arm 300 and the primary arm 100 that can be seen in FIGS. 6 & 7. When the cam rotates on the lift lobe, the secondary arm 300 starts its rocking, but it does not transmit the motion to the primary arm 100. The secondary arm 300 instead rocks in the pivot slot 102 while the primary arm 100 stays steady and the valve(s) remains closed. To avoid lift-off of the secondary arm 300 from the cam, a spring based lost motion assembly 400 can provide enough load from the secondary arm 300 to the cam. The spring force of lost motion spring 403 can be small enough so that it does not transmit motion to the valve. The balance of the lost motion assembly 400 over the cam end 310, and the placement of the primary pivot knees 103 anterior to the latch assembly 500 and secondary rocker shaft bore 308, can concentrate the weight and force of the lost motion assembly 400 over the cam end 310. The cam end can follow the cam and can return to the contacting of primary travel limit 107 and secondary travel limit 307.

Other implementations will be apparent to those skilled in the art from consideration of the specification and practice of the examples disclosed herein.

What is claimed is:

1. A latch assembly, comprising:

a main latch pin assembly comprising a first diameter on a first main pin face and a main pin body that is stepped from an outer diameter to the first diameter, and a secondary latch piston comprising a second diameter on a secondary piston face, wherein the secondary latch piston is configured to selectively act on the main latching pin assembly, wherein the main latch pin assembly is biased to oppose the secondary latch piston, and wherein the first diameter is greater than the second diameter.

2. The latch assembly of claim 1, wherein the main pin body comprises at least one anti-rotation flat.

3. A rocker arm assembly, comprising the latch assembly of claim 1 and further comprising:

a primary arm configured to receive the main latch pin assembly; and a secondary arm configured to receive the secondary latch piston.

4. The rocker arm assembly of claim 3, wherein:

the primary arm comprises a latch shelf proximal a primary rocker shaft bore, and the main latch pin assembly is installed in a primary latch bore in the latch shelf, the secondary arm comprises a latch extension proximal a secondary rocker shaft bore, and the secondary latch piston is installed in a secondary latch bore in the latch extension.

5. The rocker arm assembly of claim 4, wherein the secondary latch bore is stepped from a first inner diameter guiding the secondary latch piston to a second inner diameter that is larger than the first inner diameter.

6. The rocker arm assembly of claim 5, wherein the main latch pin assembly is biased to abut the second inner diameter when the secondary latch piston is passive.

7. The rocker arm assembly of claim 4, wherein:

the primary arm comprises a primary travel limit, the secondary arm comprises a secondary travel limit, and the secondary travel limit contacts the primary travel limit when the latch assembly is latched, but the secondary travel limit is configured to swing away from the primary travel limit when the latch assembly is unlatched.

8. The rocker arm assembly of claim 4, wherein the latch shelf comprises an anti-rotation bore and an anti-rotation pin installed in the anti-rotation bore, and wherein the main latch pin assembly comprises at least one anti-rotation flat configured to reciprocate across the anti-rotation pin.

9. The rocker arm assembly of claim 3, comprising a lost motion spring assembly spanning from the primary arm to the secondary arm.

10. The rocker arm assembly of claim 3, comprising a bearing end on the secondary arm and a valve end on the primary arm.

11. The rocker arm assembly of claim 10, wherein the bearing end, the valve end, and the latch assembly are configured to surround a rocker shaft in a triangular distribution.

12. The rocker arm assembly of claim 3, wherein the primary arm comprises a lubrication port to the main latch pin assembly.

13. The rocker arm assembly of claim 3, wherein the secondary arm comprises an actuation port to the secondary latch piston.

14. The rocker arm assembly of claim 13, wherein the secondary latch piston comprises a piston body cupped to receive an actuation fluid.

15. A latch assembly of claim 1, comprising:

a main latch pin assembly comprising a first diameter on a first main pin face, and a secondary latch piston comprising a second diameter on a secondary piston face, wherein the secondary latch piston comprises a piston body cupped to receive an actuation fluid, wherein the secondary latch piston is configured to selectively act on the main latching pin assembly, wherein the main latch pin assembly is biased to oppose the secondary latch piston, and wherein the first diameter is greater than the second diameter.

16. The latch assembly of claim 15, wherein the piston body is crenelated to form an actuation fluid passage.

17. A rocker arm assembly, comprising:

a latch assembly comprising:

a main latch pin assembly comprising a first diameter on a first main pin face, and a secondary latch piston comprising a second diameter on a secondary piston face, wherein the secondary latch piston is configured to selectively act on the main latching pin assembly, wherein the main latch pin assembly is biased to oppose the secondary latch piston, and wherein the first diameter is greater than the second diameter;

a primary arm configured to receive the main latch pin assembly, the primary arm comprises a latch shelf proximal a primary rocker shaft bore, and the main latch pin assembly is installed in a primary latch bore in the latch shelf; and a secondary arm configured to receive the secondary latch piston, the secondary arm comprises a latch extension proximal a secondary rocker shaft bore, and the secondary latch piston is installed in a secondary latch bore in the latch extension, wherein the secondary latch bore is stepped from a first inner diameter guiding the secondary latch piston to a second inner diameter that is larger than the first inner diameter, wherein the main latch pin assembly is biased to abut the second inner diameter when the secondary latch piston is passive, wherein the main latch pin assembly comprises a main pin body that is stepped from an outer diameter to the first diameter, and wherein a step abuts the second inner diameter when the secondary latch piston is passive.

* * * * *